US005112415A

United States Patent [19]

Mae

[11] Patent Number: 5,112,415

[45] Date of Patent: May 12, 1992

[54] ENGINE VALVE STEM AS WELL AS HEAD PORTION OF TITANIUM ALLOY

[75] Inventor: Yoshiharu Mae, Omiya, Japan

[73] Assignee: Mitsubishi Materials Corporation, Tokyo, Japan

[21] Appl. No.: 642,356

[22] Filed: Jan. 17, 1991

[30] Foreign Application Priority Data

Jan. 18, 1990 [JP] Japan ..... 2-8894

[51] Int. Cl.[5] ..... F01L 3/00

[52] U.S. Cl. ..... 148/421; 123/188 AA; 123/188.3; 148/11.5 F; 148/12.7 B.133; 148/527; 420/420

[58] Field of Search ..... 148/421, 11.5 F, 127 B, 148/133; 420/420; 123/188 AA; 251/368

[56] References Cited

U.S. PATENT DOCUMENTS

| | | | |
|---|---|---|---|
| 3,795,970 | 3/1974 | Keathley et al. | 148/11.5 F |
| 4,073,474 | 2/1978 | Hashimoto et al. | 123/188 AA |
| 4,433,652 | 2/1984 | Holtzberg et al. | 123/188 AA |
| 4,729,546 | 3/1988 | Allison | 123/188 AA |
| 4,852,531 | 8/1989 | Abkowitz et al. | 251/368 |
| 4,867,116 | 8/1989 | Rosa et al. | 123/188 AA |

FOREIGN PATENT DOCUMENTS

| | | |
|---|---|---|
| 0233405 | 8/1987 | European Pat. Off. . |
| 0408313 | 1/1991 | European Pat. Off. . |
| 8908770 | 9/1989 | PCT Int'l Appl. . |
| 127033 | 3/1960 | U.S.S.R. . |

*Primary Examiner*—Uprendra Roy
*Attorney, Agent, or Firm*—Scully Scott Murphy & Presser

[57] ABSTRACT

There is disclosed an engine valve of titanium alloy having a stem portion made of a cold-worked titanium alloy containing 2% to 4% by weight of aluminum, 1.5% to 3.5% by weight of vanadium and balance titanium. The engine valve suitable for use as an intake valve has a head portion made of a cast titanium alloy containing 2% to 7% by weight of aluminum, 3% to 20% by weight of vanadium and balance titanium. Moreover, an exhaust engine valve has a head portion made of a cast titanium alloy containing 5% to 10% by weight of aluminum and balance titanium.

1 Claim, No Drawings

ENGINE VALVE STEM AS WELL AS HEAD PORTION OF TITANIUM ALLOY

BACKGROUND OF THE INVENTION

1. Field of the Invention

The present invention relates to an engine valve of titanium (Ti) based alloy which is suitably used in various internal combustion engines for automobiles or the like.

2. Prior Art

An engine valve of Ti based alloy has been recently developed for use in various internal combustion engines for automobiles and the like in order to obtain light weight engines, and has been put to partial practical use.

Among the conventional Ti alloy engine valves, an intake valve has been manufactured using a Ti alloy having a representative composition of Ti-6%Al-(aluminum)-4%V(vanadium) by weight, while an exhaust valve has been made of a Ti alloy having a representative composition of Ti-6%Al-2%Sn(tin)-4%Zr(zirconium)-2%Mo(molybdenum)-0.1%Si(silicon). For manufacturing the engine valve, an ingot of the above alloy has been first subjected to hot working such as hot forging and hot rolling, to thereby produce a bar stock (wire member) of a prescribed length, and then a head portion has been formed at one end thereof by means of hot upset forging.

In the conventional Ti alloy engine valves, however, since Ti alloy is less suited to hot working, repeated working operations with small degrees of working have been required, so that the processing cost has been unduly increased. In addition, inasmuch as the selection of the kind of Ti alloy has been restricted due to the difficulty in workability. Therefore, Ti alloy having desired properties cannot be utilized, so that Ti alloy engine valves having satisfactory characteristics cannot be successfully obtained.

SUMMARY OF THE INVENTION

It is therefore an object of the present invention to provide a titanium alloy engine valve which has desired properties and can be easily manufactured at a reduced cost.

According to the present invention, there is provided an engine valve of titanium alloy comprising a stem portion made of a cold-worked titanium alloy essentially consisting of 2% to 4% by weight of aluminum, 1.5% to 3.5% by weight of vanadium and balance titanium.

The engine valve for use as an intake valve is further characterized in that the head portion is made of a cast Ti alloy which essentially consists of 2% to 7% by weight of Al, 3% to 20% by weight of V and balance Ti. Moreover, the engine valve used as an exhaust valve is characterized in that the head portion is made of a cast Ti alloy which essentially consists of 5% to 10% by weight of Al and balance Ti.

DETAILED DESCRIPTION OF THE INVENTION

The inventors have made an extensive study over the improvement of the conventional Ti alloy engine valves, and have obtained an engine valve of Ti alloy which has a stem portion made by means of cold working of a Ti alloy essentially consisting of 2% to 4% by weight of Al, 1.5% to 3.5% by weight of V and balance Ti. In general, the stem portion must have a great fatigue strength at high temperature since it is exposed to repeated impact loading at high temperature. The Ti alloy specifically selected as above provides an excellent fatigue strength at high temperature to the stem portion. In addition, the alloy exhibits an excellent workability in both hot working and cold working, so that it can be easily processed into a bar or wire stock for the stem portion at a reduced cost.

Furthermore, the head portion of the engine valve should be preferably manufactured of different Ti alloys depending upon whether the valve is to be used as intake or exhaust ones, because the head portion of the intake valve must have great strength and wear resistance while that of the exhaust valve must have high heat resistance. Thus, the head portion of the intake engine valve in accordance with the present invention is made of a Ti alloy essentially consisting of 2% to 7% by weight of Al, 3% to 20% by weight of V and balance Ti, while that of the exhaust valve is made of a Ti alloy essentially consisting of 5% to 10% by weight of Al and balance Ti. These alloys meet the above requirements. However, these alloys are inferior in workability not only in cold working operation but hot working operation as well. Therefore, the head portions are manufactured by means of metal mold casting, by which the manufacturing cost can be reduced substantially. The stem and head portions thus produced are then joined together by means of friction welding. With these procedures, engine valve having desired properties can be successfully manufactured at a reduced cost.

In the foregoing, the composition ranges of the alloys have been determined due to the following reasons:

(a) Al and V Contents in Stem Portion

Al and V coexisting in the stem portion serve to enhance the fatigue strength at high temperature. However, if the Al and V contents become less than 2% and 1.5% by weight, respectively, a sufficient fatigue strength at high temperature cannot be obtained. On the other hand, if the Al and V contents exceed 4% and 3.5% by weight, respectively, cold workability is abruptly reduced. Therefore, the Al and V contents have been determined as described above.

(b) Al and V Contents in Head Portion for Intake Valve

Al and V serve to enhance the strength and the wear resistance (hardness). However, if the respective Al and V contents are less than 2% by weight and 3% by weight, the desired effects cannot be obtained. On the other hand, if the Al and V contents exceed 7% by weight and 20% by weight, respectively, the head portion becomes brittle and the strength is reduced. Therefore, the Al and V contents in the head portion have been determined as described above.

(c) Al Content in Head Portion for Exhaust Valve

Al serves to increase the heat resistance. However, if the Al content is less than 5% by weight, an excellent heat resistance cannot be ensured. On the other hand, if the content exceeds 10% by weight, a number of embrittling phases are precipitated. Thus, the content has been limited so as to range from 5% to 10% by weight.

The present invention will now be described in more detail by way of the following example.

EXAMPLE

Ti alloys having various compositions as set forth in Tables 1 and 2 were prepared using a conventional vacuum arc furnace, and were cast into ingots having a diameter of 600 mm and a length of 2,000 mm. The ingots thus obtained were subjected to hot forging two times at a starting temperature of 1,050° C. to reduce the diameter to 80 mm, and were further subjected to hot rolling one time at a starting temperature of 900° C. and to cold wire drawing two times at a reduction of 60%, so that wire members of 5 mm in diameter were produced. Thereafter, the wire members were subjected to annealing by holding them at a temperature of 450° C. for two hours, and finally to cold straightening operations. Thus, the stem portions for the valves of the invention were manufactures.

Furthermore, Ti alloys having compositions as set forth in Tables 1 and 2 were prepared in a skull melting furnace using plasma as heating sources, and were subjected to centrifugal casting using a rotating mold, so that head portions for intake or exhaust valves having an outer diameter of 35 mm were manufactured. Thereafter, the head portions thus produced were respectively joined to the above stem portions by a known friction welding. Thus, the Ti alloy engine valves 1 to 7 of 100 mm long, in accordance with the present invention, were manufactured.

For comparison purposes, conventional Ti-6%Al-4%V alloy and Ti-6%Al-2%Sn-4%Zr-2%Mo-0.1%Si alloy were prepared using the same vacuum arc furnace, and were cast into ingots having a diameter of 600 mm and a length of 1,000 mm. The ingots thus obtained were subjected to hot forging two times at a starting temperature of 1,050° C. to reduce the diameter to 80 mm. Then, the Ti alloys were repeatedly subjected to hot rolling three times, at a starting temperature of 900° C. for the Ti-6%Al-4%V alloy and 1,050° C. for the Ti-6%Al-2%Sn-4%Zr-2%Mo-0.1%Si alloy, respectively, to produce wire members of 5 mm in diameter. Subsequently, prescribed blanks were cut out from these wire members, and one ends were subjected to hot upsetting, at a temperature of 950° C. for the Ti-6%Al-4%V alloy and 1050° C. for the Ti-6%Al-2%Sn-4%Zr-2%Mo-0.1%Si alloy, respectively. Thus, a comparative intake valve having a length of 100 mm and a head portion of 35 in outer diameter was manufactured of the Ti-6%Al-4%V alloy, while a comparative exhaust valve of the same dimension was produced of the Ti-6%Al-2%Sn-4%Zr-2%Mo-0.1%Si alloy.

Subsequently, the engine valves thus obtained were tested to evaluate their characteristics. More specifically, inasmuch as the stem portion is required to have a great fatigue strength at high temperature, the fatigue limits at several temperatures of 400° C., 450° C. and 500° C. were measured under a fatigue test condition in which rectangular pulse had a minimum stress/maximum stress ratio of 0.1. In addition, with respect to the head portion of the intake valve, since it is required to have great strength and wear resistance, tensile strength, elongation, and Vickers hardness were measured in order to evaluate these characteristics. With respect to the head portion of the exhaust valve, it is required to have great heat resistance. Therefore, rapture strength at a temperature of 800° C. and a rupture time of 100 hours was measured. The results are set forth in Tables 1 and 2.

TABLE 1

| Stem portion | | | | | Head Portion | | | |
|---|---|---|---|---|---|---|---|---|
| | Fatigue Limit (kg/mm²) | | | | | | | |
| Composition (wt %) | 400 | 450 (°C.) | 500 | | Composition (wt %) | Tensile strength (Kg/mm²) | Elongation (%) | Vickers hardness (%) |
| Intake Valve of the invention | | | | | | | | |
| 1 Ti—3%Al—2.5%V | 18 | 16 | 14 | | Ti—6%Al—6%V—2%Sn | 111 | 8 | 340 |
| 2 Ti—3%Al—2.5%V | 18 | 16 | 14 | | Ti—3%Al—13%V—11%Cr | 140 | 4 | 415 |
| 3 Ti—3%Al—2.5%V | 18 | 16 | 14 | | Ti—3%Al—10%V—2%Fe | 120 | 3 | 360 |
| 4 Ti—3%Al—2.5%V | 18 | 16 | 14 | | Ti—3%Al—15%V—3%Cr—3%Sn | 138 | 6 | 410 |
| Comparative intake valve | | | | | | | | |
| Ti—6%Al—4%V | 15 | 14 | 12 | | Ti—6%Al—4%V | 92 | 10 | 290 |

TABLE 2

| Stem portion | | | | | Head Portion | |
|---|---|---|---|---|---|---|
| | Fatigue Limit (kg/mm²) | | | | | |
| Composition (wt %) | 400 | 450 (°C.) | 500 | | Composition (wt %) | Rapture strength (Kg/mm²) |
| Exhaust Valve of the invention | | | | | | |
| 5 Ti—3%Al—2.5%V | 18 | 16 | 14 | | Ti—7%Al—2%Sn—4%Zr—2%Mo—0.1%Si | 7.0 |
| 6 Ti—3%Al—2.5%V | 18 | 16 | 14 | | Ti—8%Al—1%Sn—2%Zr—1%Mo—0.1%Si | 7.9 |
| 7 Ti—3%Al—2.5%V | 18 | 16 | 14 | | Ti—8%Al—2%Sn—4%Zr—2%Mo—0.1%Si | 8.8 |
| Comparative exhaust valve | | | | | | |

TABLE 2-continued

| Stem portion | | | | Head Portion | |
|---|---|---|---|---|---|
| | Fatigue Limit (kg/mm²) | | | | |
| Composition (wt %) | 400 | 450 (°C.) | 500 | Composition (wt %) | Rapture strength (Kg/mm²) |
| Ti—6%Al—2%Sn—4%Zr—2%Mo—0.1%Si | 16 | 15 | 13 | Ti—6%Al—2%Sn—4%Zr—2%Mo—0.1%Si | 5.0 |

As will be seen from the results of Tables 1 and 2, the Ti alloy engine valves of the invention exhibit excellent characteristics as compared with the comparative engine valves. More particularly, the stem portions of the intake valves 1 to 4 of the invention exhibit excellent fatigue strength at high temperature, while the head portions thereof exhibit great strength and hardness. Furthermore, the exhaust engine valves 5 to 7 of the invention are superior in heat resistance for the head portions as compared with the comparative exhaust valve.

As described above, in the Ti alloy engine valve in accordance with the present invention, the stem portion has an excellent fatigue strength at high temperature, while the head portion of the intake valve exhibits a high strength as well as an excellent wear resistance. In addition, the head portion of the exhaust valve has a superior heat resistance. Therefore, when the engine valve of the invention is put to use in internal combustion engines for automobiles, it positively exhibits superior performance over a prolonged period of time.

Obviously many modifications and variations of the present invention are possible in the light of the above teachings. It is therefore to be understood that within the scope of the appended claims, the invention may be practiced otherwise than as specifically described.

What is claimed is:

1. An engine valve of titanium alloy comprising a stem portion constituted of a cold-worked titanium alloy essentially consisting of 2% to 4% by weight of aluminum, 1.5% to 3.5% by weight of vanadium and with the balance being titanium; and a head portion welded to said stem portion constituted of a cast titanium alloy essentially consisting of 5% to 10% by weight of aluminum and with the balance being titanium.

* * * * *